US006415991B1

(12) United States Patent
Eriksson

(10) Patent No.: US 6,415,991 B1
(45) Date of Patent: Jul. 9, 2002

(54) SILENCED BLOWING NOZZLE

(75) Inventor: Gunnar Eriksson, Arnäsvall (SE)

(73) Assignee: Silvent Aktiebolag, Boras (SE)

( * ) Notice: Subject to any disclaimer, the term of this patent is extended or adjusted under 35 U.S.C. 154(b) by 0 days.

(21) Appl. No.: 09/700,393

(22) PCT Filed: Apr. 20, 1999

(86) PCT No.: PCT/SE99/00624

§ 371 (c)(1),
(2), (4) Date: Nov. 14, 2000

(87) PCT Pub. No.: WO99/60279

PCT Pub. Date: Nov. 25, 1999

(30) Foreign Application Priority Data

May 15, 1998 (SE) ..... 9801737

(51) Int. Cl.[7] ..... B05B 1/28
(52) U.S. Cl. ..... 239/290; 239/291; 239/296
(58) Field of Search ..... 239/290, 291, 239/296, 398, 418, 419.5, 421, 424, 424.5, 425, 425.5

(56) References Cited

U.S. PATENT DOCUMENTS 4,392,617 A * 7/1983 Bakos et al. ..... 239/290
4,675,493 A * 6/1987 Gartland et al. ..... 219/74
5,540,385 A * 7/1996 Garlick ..... 239/290
5,714,113 A * 2/1998 Gitman et al. ..... 266/182
5,858,302 A * 1/1999 Gitman et al. ..... 266/182

FOREIGN PATENT DOCUMENTS

SE 448 828 3/1987 ..... B05B/1/00

* cited by examiner

*Primary Examiner*—William C. Doerrler
*Assistant Examiner*—Davis Hwu
(74) *Attorney, Agent, or Firm*—Michael D. Bednarek; Shaw Pittman LLP

(57) ABSTRACT

The present invention relates to a silenced blowing nozzle for blowing of a static gas medium under overpressure, in particular air, having in a central part (6) of the nozzle at least one first discharge opening (11) embodied to generate a core stream of gas with supersonic velocity. The central part is surrounded by a more peripheral part (5) containing a number of second discharge openings (13) spaced from each other and from said first discharge opening(s), the said second discharge openings being embodied to generate a gas flow with lower velocity than the core stream, preferably a velocity equal to sonic velocity, which gas flow surrounds the core stream and has the same direction as said core stream.

9 Claims, 2 Drawing Sheets

SILENCED BLOWING NOZZLE

FIELD OF INVENTION

The present invention relates to a silenced blowing nozzle for emitting a gas medium, in particular air, under high overpressure.

DESCRIPTION OF THE BACKGROUND ART

For many years within the engineering industry, blowing nozzles of so-called "silent type" have been used, i.e. blowing nozzles which for a given blowing force are considerably quieter than corresponding standard blowing nozzles. Belonging to this group of blowing nozzles are tapered slot nozzles of type Silvent® 511 and 512, cupped hole nozzles of type Silvent® 208 and 209 and blowing nozzles with flat ends, type Silvent ® 701–720. These blowing nozzles are used for low and moderate blowing forces and blowing distances. So-called "large blowers" are used where large blowing forces are required at long distances. Belonging to this group are aggregates consisting of a larger number of co-operating hole nozzles, which belong to the Silvent® 1100- and 1200-series of the same applicant. These tools are used for instance for applications in steel plants, paper mills, and foundries for cleaning, cooling, drying etc.

However in certain cases within the pulp and paper industry, blowing nozzles with even higher air flows are used, which generate extremely high noise levels due to the expansion of the air stream after it has left the nozzle. The operator can be subject to a level of approx. 115 dB(A), and for other personnel in the vicinity of the discharge, it is not unusual with values in the range 100–110 dB(A). As the nozzle is often required for sudden interruptions in production at the factory, e.g. when a paper web goes out of line, high requirements are placed on the personnel for immediate action. Many times one simply does not have time to put on hearing protection, which in unfortunate cases can imply permanent hearing damage after only a few seconds of exposure time.

The powerful air nozzles used within the pulp and paper industry can be said to have two areas of application. In one case the air is used as a bearing surface for the paper web in connection with start-up of the paper machine, "pulls the leading end". In this case the air must act as a guide, helping to steer the paper web between rollers in the paper machine. In this case it is suitable that the flow be moderately large and that it be distributed over a large area. The other case is when the paper web has broken and a quickly growing amount of paper must be blown immediately away from the machine at the same time as the leading end must be steered into the correct position. For cleaning, a very strong, concentrated air stream is required, which tends to tear apart the web even at large distances from the nozzle itself; the distance can reach up to 10 m! Other devices for managing the said tasks are not available within known technology. Certain limited tasks can be managed by blowing nozzles with fixed installation, but in all essential work the hand-regulated blowing nozzle, which generates extremely high noise levels, is necessary for giving the required flexibility in use.

BRIEF DISCLOSURE OF THE INVENTION

The object of the present invention is to offer an efficient blowing nozzle with which a significantly higher and/or quieter blowing force can be achieved for a given frontal area than with corresponding known nozzles.

The invention has been developed especially to solve the above-mentioned problems and to meet needs within the pulp and paper industry, and hereby aims to offer a blowing nozzle which can generate very large blowing forces at significantly lower noise levels than for comparable conventional nozzles. Other areas where these nozzles can be used are e.g. steel plants, foundries etc. The principles of the invention can, however, also be applied to nozzles for small or moderate blowing forces, where the nozzle according to the invention can replace conventional or silenced blowing nozzles employed within the engineering industry.

To achieve the desired blowing force, the nozzle according to the invention comprises at least one first discharge opening in a central part of the nozzle, where the first discharge opening is diverging, suitably formed as a Laval nozzle, to give the discharging gas, normally air, supersonic velocity at the pressure prevailing most immediately behind the discharge. For a correctly formed Laval nozzle, the pressure of the air/gas is converted completely to kinetic energy, which implies that the gas stream does not expand sideways after it has left the nozzle, as is the case for conventional nozzles, where the expansion creates intense noise. A powerful noise occurs nevertheless when gas flows with supersonic velocity out of a correctly dimensioned Laval nozzle. This is assumed caused by violent turbulence arising in the boundary zone between the gas/air stream which rushes forward with a very high velocity, and the surrounding air. The invention aims to solve this problem. According to the invention, the vortex formation in a gas exiting with supersonic velocity in a core stream near said first discharge opening, and therewith the generation of high frequency sound within the audible region, is suppressed in that the core stream is surrounded by a gas flow aimed in the direction of the core stream, which prevents or significantly reduces vortex formation of the core stream near said discharge opening, by which the initially mainly laminar character of the core stream is preserved to a large degree at least within a critical region near the discharge, where the velocity of the core stream is greatest.

The invention is thus based on the interaction of two principles:

1. The core stream is formed such that the working capacity thereof becomes maximum by said core stream emitted through an expanding (diverging) exit (discharge) opening which is formed such—preferably in the form of a Laval nozzle—that the internal energy of the gas is almost completely transformed into velocity under the influence of the pressure prevailing immediately behind the exit opening. For the dimensional ranges specific to the invention, the velocity in the discharge section of the nozzle lies far above sonic velocity.

2. The formation of turbulence around the rapidly gushing core stream is decreased by said core stream being surrounded by a protective gas flow aimed in the direction of said core stream. The velocity of the surrounding flow shall be lower than that of the core stream. The protective gas flow is released by a larger number of smaller exit (discharge) openings situated around the core stream—this is to suppress vortex formation due to the interaction with surrounding air and therewith also to suppress the generation of sound within the audible region. The most favourable condition is reached if the velocity of the protective gas flow decreases gradually with increased distance from the centre line.

Acoustically, the combination of these principles implies that the sound generation becomes relatively low in that the turbulence of the core stream is suppressed in a region downstream of the discharge orifice within which powerful generation of high frequency sound within the audible region otherwise takes place.

Mechanically, the combination implies a nozzle with a very high degree of efficiency, as the surrounding gas flow causes insignificant slowing down of the velocity of the core stream in the critical region after the orifice by the surrounding stationary air, as most of the mechanical work in accelerating the stationary air in the direction of the core stream is carried out by the surrounding gas flow.

The outstanding feature of the invention is thus that the blowing nozzle in a central part thereof has at least one first exit (discharge) opening formed to generate a core stream of gas with supersonic velocity and that the central part is surrounded by a more peripheral part containing a number of second discharge openings at a distance from each other and from the said first discharge opening(s), which second discharge openings are formed to generate a gas flow with lower velocity than that of the core stream, preferably a velocity equal to sonic velocity, which gas flow surrounds and has the same direction as said core stream.

Said first discharge opening can have a diameter at the most narrow section of up to between 2 and 20 mm, preferably to between 4 and 10 mm, preferably maximum 7 mm and most preferably up to between 5 and 6 mm.

The second discharge openings, especially when these are arranged in the periphery of the nozzle, can be advantageously formed as thin slit openings which extend radially across the projected end area of the nozzle, perpendicular to the longitudinal axis thereof. To form a blowing nozzle with such slit-formed, radially oriented discharge openings in the periphery of the nozzle is known per se through e.g. EP 0 224 555 and the principle is practised in the 700-series of Silvent AB, see above, but has according to the invention at least two purposes in the nozzle. Firstly, the peripheral discharge openings act so that the blowing force reaches a high degree of efficiency even at large distances, secondly the gas stream flowing out through the peripheral openings and surrounding the central gas stream which flows out with supersonic velocity, muffles the otherwise very powerful sound which forms by interaction between the central gas stream with supersonic velocity and the surrounding air, by suppressing the turbulence of the core stream in a critical region. Thus the noise has, on trials done with blowing nozzles according to the invention and compared with a conventional nozzle in the paper industry, at a working pressure of 500 kPa, been reduced from 115 dB(A) for the conventional nozzle to 100 dB(A) for the new nozzle and this with maintained or amplified blowing force. This extraordinarily effective reduction in noise can be utilized for significantly improving the working conditions at existing compressed air equipment and/or for making new equipment significantly less expensive.

Starting with the theory that a good reduction in noise is favoured by a successively decreasing difference in discharge velocity from the central core stream to surrounding air, one can also consider that further discharge openings—tertiary, fourth, etc—be arranged between said first and second discharge openings, by which these interjacent discharge openings may be formed so that the gas streaming out of these openings also reaches supersonic velocity, although not as high as the supersonic velocity of the central stream. With this developmental embodiment, the tertiary discharge openings arranged around the first discharge opening(s) should thus be shaped to give an air velocity only somewhat lower than the velocity in the core stream, while, if even further discharge openings, here called fourth discharge openings, are arranged between said tertiary and second discharge openings, the said fourth discharge openings are formed such that they give an air velocity which is somewhat higher than sonic velocity, although lower than the velocity from the tertiary discharge openings, and so on.

Said possibly occurring tertiary, fourth etc discharge openings can also be formed as Laval nozzles to make supersonic velocity possible, but in order not to give the maximum possible supersonic velocity, some form of pressure reducer, e.g. restriction flange or similar contraction, should be arranged in the inlet lines.

As high sound frequencies are easier to muffle than low ones, it is acoustically advantageous to replace one large discharge outlet with several small ones. This principle has been utilized for nozzles which work at discharge velocities equal to sonic velocity, but can also be applied to Laval nozzles. For a circular discharge outlet, maximum sound generation occurs at a frequency $f_{max}$ which is proportional to the diameter of the outlet d and the discharge velocity w. It can therefore be advantageous to use several Laval nozzles in a central part of the blowing nozzle instead of one larger nozzle. An embodiment of the invention is characterized by such an arrangement.

The energy content of the sound generated from the second, peripheral discharge openings should have maximum at a frequency above 20 kHz, that is above the normal upper limit for human hearing. This can be achieved by making the discharge openings as narrow as possible without risk for blocking due to contamination of the compressed air. At the same time, the discharge area and therewith gas flow should be sufficient to suppress said vortex formation to desired degree of significance, which is achieved by a sufficient number of second discharge openings. More exactly, the total discharge area of the second discharge openings should be 1 to 4 times, preferably 1.5 to 3 times as large as the total discharge area of said first discharge opening(s) considered in the most narrow section of the openings, suitably about 2 times as large. With this division, a large blowing force has been achieved at a low sound level.

Generally, it can be further said that the distance between adjacent discharge openings in each concentric group of discharge openings, that is within the central group consisting of several first discharge openings, possibly tertiary and fourth etc, as well as said second discharge openings, should reach 2 to 5 times the equivalent diameter of the openings, which is the square root of the orifice area of the openings, when the openings are slit-formed or otherwise not round.

The outer radius of the nozzle can be 2.5 to 5 times, preferably approx. 3 times the diameter of the most narrow section in the first discharge opening, when this is composed of a single central Laval nozzle. Further, the radial distance between the innermost part of the second discharge openings and the point on the periphery of the first discharge opening (s) in the orifice should amount to at least a third of the radius of the nozzle, where the radius is defined as the distance from the centre to the outer point of the second discharge openings, and where discharge openings are not arranged between said first and second discharge openings.

Further characteristic features and aspects of the invention will be evident from the patent claims as well as from the following description of a number of conceivable embodiments.

BRIEF DESCRIPTION OF THE DRAWINGS

In the following description of some conceivable embodiments of the invention, reference will be made to the accompanying drawings, of which

DETAILED DESCRIPTION OF EMBODIMENTS

Figure 1:
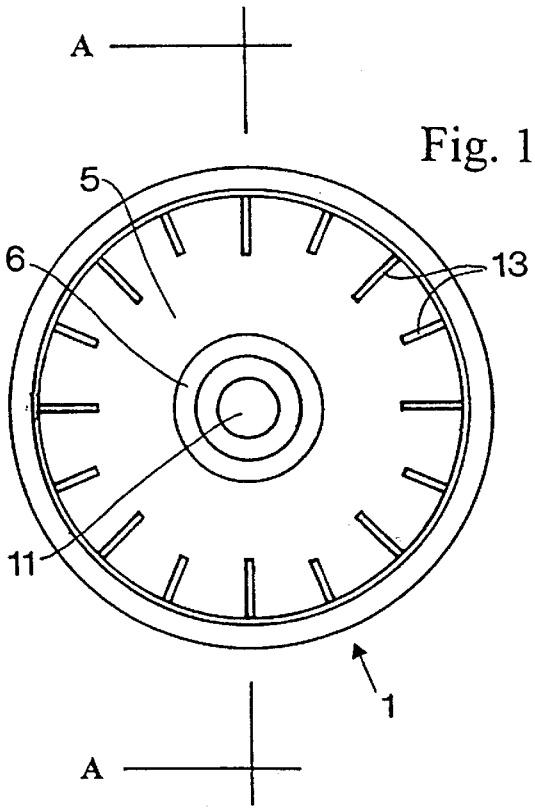
FIG. 1 shows an end view of a nozzle according to a first embodiment of the invention.
Figure 3:
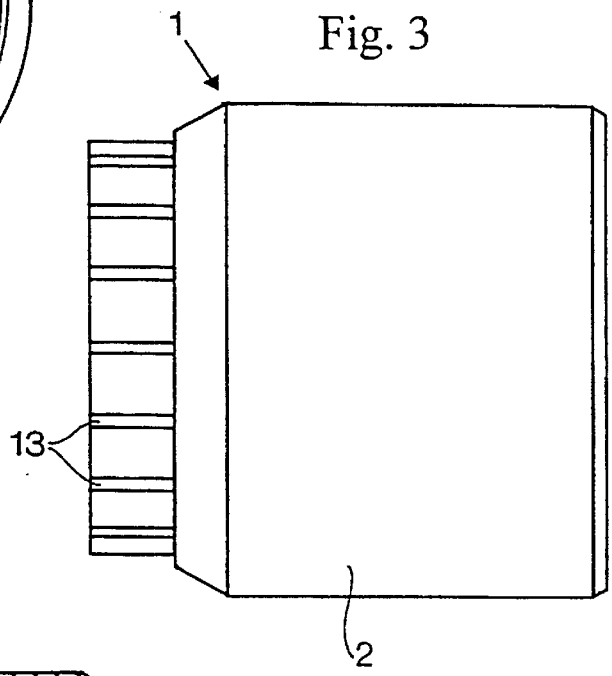
FIG. 3 shows a side view of the same nozzle.
Figure 2:
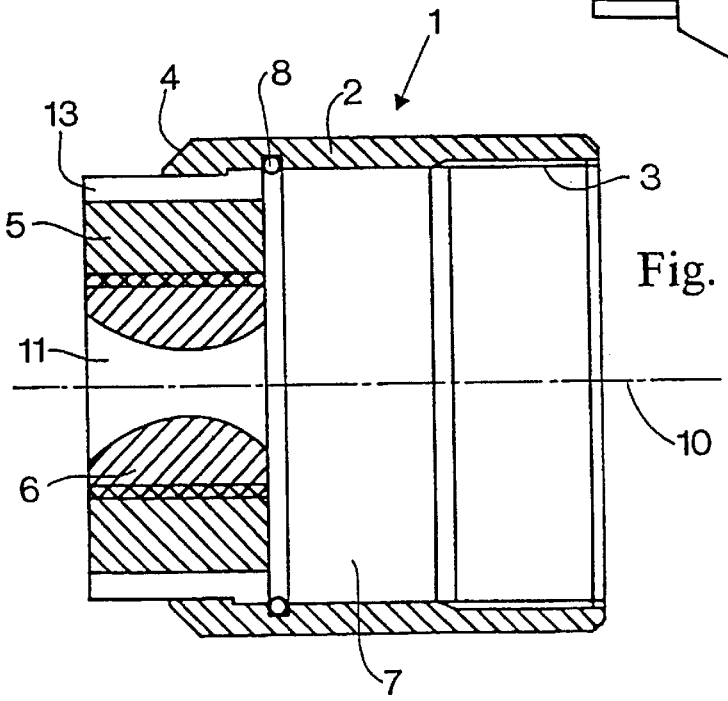
FIG. 2 shows a longitudinal section along line A—A in FIG. 1.

With reference first to FIGS. 1–3, a blowing nozzle is identified generally by the reference numeral 1. It consists of a tube-shaped casing 2 with internal threads 3 in a rear end as well as an outer and an inner nozzle body 5 respectively 6 in the front end of the casing, of which the front end part 4 is bevelled to a cone shape.

The casing 2 is connectable with the threads 3 to a compressed air line not shown, which connects the nozzle 1 with a compressed air source, so that an overpressure of at least 200 kPa can be maintained in a nozzle chamber 7 immediately behind the nozzle bodies 5 and 6. The outer nozzle body 5 is mounted by press fitting in the casing 2. It protrudes past the front part 4 of the casing and its rear end abuts against a clamp ring 8. The outer and central nozzle parts 5, 6 are embodied as matching screw and nut, of which the central nozzle part 6 is threaded into the outer nozzle part 5. It is perceived that this gives possibility for changing of the central nozzle part.

According to the embodiment, the nozzle 1 has two separate discharge systems, which extend in parallel with the longitudinal axis 10 of the nozzle, namely a central or first system and a peripheral or second system. The first system includes a first discharge opening 11 central in the central nozzle body 6. This central discharge opening 11 is shaped as an expansion- or Laval nozzle, which at prevailing high pressure in the chamber 7 facilitates an air discharge velocity above sonic velocity. The maximum velocity, $w_{max}$, of a gas streaming out through a correctly embodied Laval nozzle can be expressed as $$w_{\max} = w^* \frac{x+1}{\square x-1}$$

where w* is the critical velocity for the gas in question, which in turn is equal to the local sonic velocity, and where x is a constant for the actual gas. For air, x=1.4. It follows that $w_{max}$=w* 2.4 =2.45 w*. At 20° C., the speed/velocity of sound is 314 m/s, which □0.4 implies that the maximum blowing/discharge velocity should be 769 m/s at a temperature of 20° C.

Whether or not the capacity of the Laval nozzle for generating a stream of air or other gas with theoretically maximum or otherwise with very high discharge velocity is utilized fully, the sound level from such a stream is normally very high. To muffle the sound, the nozzle 1 has therefore also been supplied with the second or peripheral discharge system, which according to the embodiment includes several slit openings 13 evenly distributed along the periphery of the nozzle 1. Even circular openings in the second system are conceivable, as are all transitory forms between circular and slit-formed, e.g. wedge-formed with the point of the wedge directed towards the centre. According to the preferred embodiment, the openings are however slit-formed, with every second opening shorter in radius than the adjacent slit openings. More exactly, the openings 13 are formed according to the principles described in said EP 0 224 555, the disclosure of which is herewith through reference incorporated into this patent application. Through the openings 13, which in the following patent claims are named second discharge openings, air streams out with a velocity equalling sonic velocity at the prevailing pressure in the chamber 7.

The gas jets which stream out through the discharge openings 13 form a more or less integrated, continuous shroud, which surrounds the central core jet streaming out at supersonic velocity from the Laval nozzle 11 with sonic velocity and thereby muffles the emanated sound. For sufficient effect regarding the capacity for suppressing turbulence in the core jet, and therewith suppressing also undesired slowing down of the core jet as sound generation within a critical region, it is believed to be suitable that the total discharge area of the peripheral discharge openings 13 is larger than the opening area in the central system, whether it be the central system including a single Laval opening 11 or several, all considered in the most narrow section of the openings. The discharge area of the outer system should be preferably 1–4 times, suitably 1.5 to 3 times or approximately double the opening area in the central system.

At the same time the peripheral discharge openings 13 themselves generate a gas flow with relatively low noise level, where it is significant that the peripheral gas/air jets have the possibility of co-ejecting air from the surroundings. The slit-formed openings 13 in the nozzle 1 lie therefore near the outer edges in the front of the nozzle 1, at the same time as the nozzle body 5 protrudes from the casing 2 for co-ejection of the air surrounding the nozzle.

Figure 4:
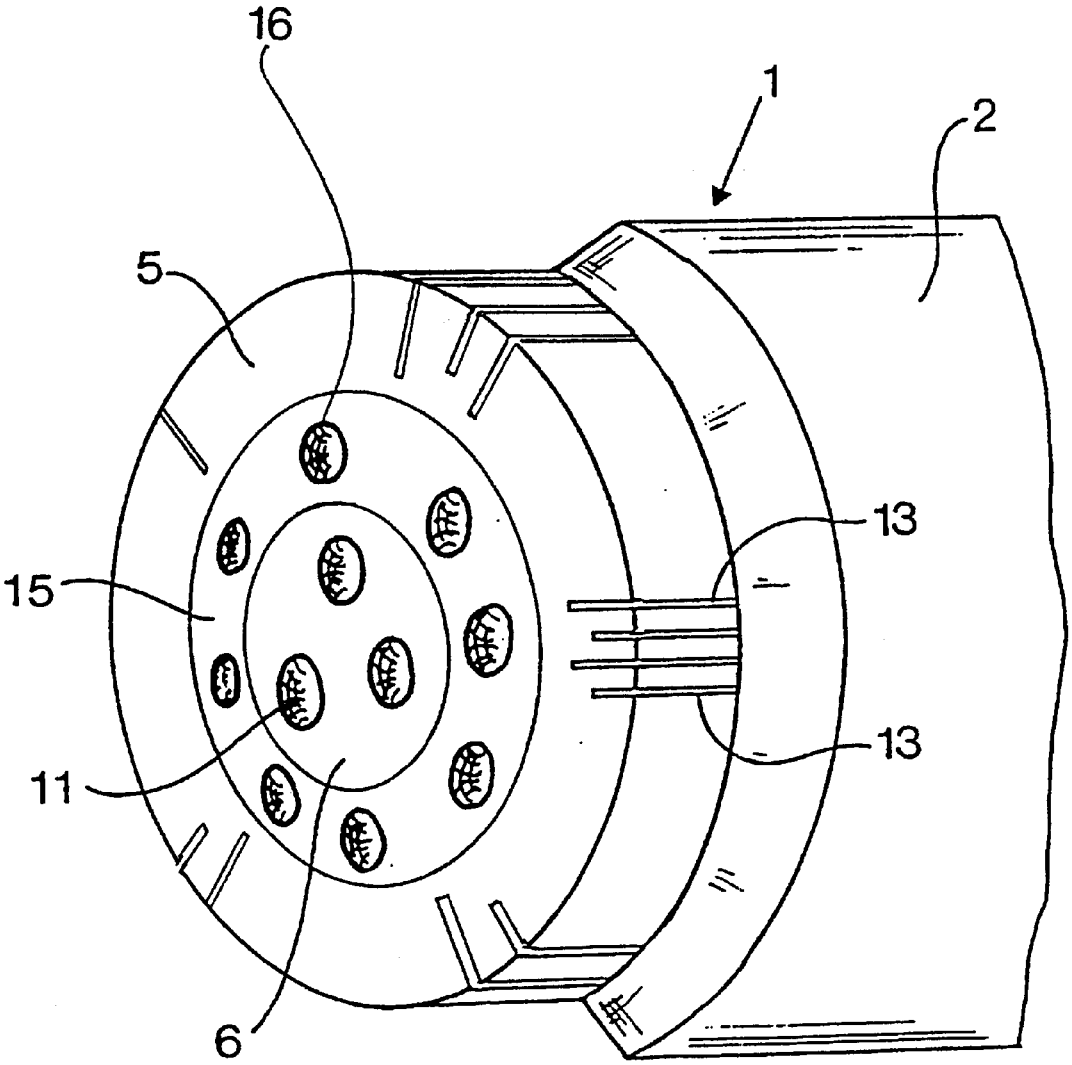
FIG. 4 shows in perspective a circular nozzle according to a second embodiment of the invention.

FIG. 4 illustrates a conceivable embodiment for generating extremely large blowing forces. This embodiment is at the same time an example of the application of the desired principle that the discharge velocity of the gas flow gradually decreases with increasing distance from the core jet. In the figure the same reference numerals are used for details which have equivalence in FIG. 1–3. According to the embodiment there is an interjacent nozzle body 15 between the outer nozzle body 5 and the central nozzle body 6. Inside the central nozzle body 6 there are three discharge openings 11 arranged, embodied as Laval nozzles, and in the interjacent nozzle body 15 is a larger number of discharge openings 16, in the appending patent claims named tertiary discharge openings, each embodied as a Laval nozzle. According to the embodiment, eight such tertiary Laval nozzles 16 are arranged in the interjacent nozzle body 15. In the outer nozzle body 5 there are slit-formed discharge nozzles 13 arranged in the same manner as in the previous embodiment, however in considerably larger number than in the previous embodiment.

The central, first discharge openings 11 are in embodiment according to FIG. 4 designed to generate air streams which exceed sonic velocity significantly. Even said tertiary discharge openings 16 in the interjacent nozzle bodies 15 are designed to generate air streams with velocity greater than sonic velocity. Nevertheless the openings 16 can here be shaped to generate air streams which with certainty have a velocity greater than sonic velocity but lower than the velocity of the air streams from the central openings 11. The lower velocity of the air streams from the interjacent tertiary discharge openings 16 can also be achieved by a pressure reducer arranged behind the discharge openings 16 or in some other manner. If the velocity from the interjacent discharge openings 16 is lower than the velocity from the central discharge openings 11, and otherwise similar conditions apply, especially regarding the frequency of sound, then the level of sound from the interjacent discharge openings will become lower than from the central discharge openings 11. Further the outer discharge openings 13 have a total flow-through area which is larger than the flow-through area of the interjacent tertiary discharge openings 16, which in turn have a larger total flow-through area considered in the most narrow section than the flow-through area of the central discharge openings 11. E.g. the area relationship between the nozzle openings 13/16/11 can be 9/3/1 or e,g, 4/2/1 or more generally 4–9/2–3/1.

It shall be realized that the gas which streams out through the various nozzle openings can be air or other gas. The fact that air is named in certain cases shall therefore not pose any limitation regarding the applicability of the nozzle. Examples of gases other than air include oxygen gas and inert protective gases. Combinations are also conceivable, e.g. the core stream being comprised of an oxygen gas stream surrounded by a peripheral flow of inert gas.

What is claimed is:

1. Silenced blowing nozzle for blowing of a gas medium under overpressure, in particular air, characterized in that a central part (6) of the blowing nozzle has at least one first discharge opening (11) embodied to generate a core stream of gas with supersonic velocity, and in that the central part is surrounded by a more peripheral part (5) containing a number of second discharge openings (13) spaced from one another and from said first discharge opening(s), which second discharge openings are embodied to generate a gas flow with lower velocity than the core stream, preferably a velocity equal to sonic velocity, which gas flow surrounds the core stream and has the same direction as said core stream;

said silenced blowing nozzle further characterized in that the total discharge area of the second discharge openings is greater than the total discharge area of said at least one first discharge opening considered in the most narrow section of said at least one first discharge opening.

2. Blowing nozzle according to claim 1, characterized in that the distance between the second discharge openings (13) is 2–5 times the opening diameter of the discharge openings, in the case the openings are round, and respectively 2–5 times the equivalent diameter of the openings, which is the square root of the flow-through area in the orifice of the openings, in the case the second discharge openings are slit-formed or otherwise not round.

3. A Blowing nozzle according to claims 1, characterized in that the total discharge area of the second discharge openings is 1–4 times the total discharge area of said first discharge openings considered in the most narrow section of the openings.

4. Blowing nozzle according to claims 1, characterized in that the radial distance between the inner part of the second discharge openings (13) and a point on the periphery in the orifice of the first discharge opening(s) (11) amounts to at least a third of the radius of the nozzle, where this is defined as the distance from the centre to the outer point of the second discharge openings.

5. Blowing nozzle according to claim 1, characterized in that the distance between adjacent first discharge openings, when these are more than one amounts to 2–5 times the diameter of the first discharge openings in the orifice.

6. Blowing nozzle according to claim 1, characterized in that tertiary discharge openings (16) are arranged between said first and second discharge openings, which tertiary discharge openings are embodied so that at the prevailing pressure behind said tertiary discharge openings, the outflowing air is given a velocity which is greater than sonic velocity but lower than the velocity of the air streaming out through said first discharge openings.

7. Blowing nozzle according to claim 6, characterized in that the total discharge area of the tertiary discharge openings is larger than the discharge area of said first discharge openings, and respectively the total discharge area of said first discharge openings.

8. Blowing nozzle according to claim 6, characterized in that the total discharge area of the discharge openings in each group of co-axial discharge openings is greater than the total discharge area of the group of co-axial discharge openings lying most immediately within, all considered in the most narrow section of the openings.

9. Blowing nozzle according to claim 1, characterized in that said first discharge opening(s) has a diameter in the most narrow section of the nozzle amounting to between 2 and 20 mm, preferably to between 4 and 10 mm, suitably to maximum 7 mm and most preferably to between 5 and 6 mm.

* * * * *